US005374220A

United States Patent [19]

Burtchett

[11] Patent Number: 5,374,220

[45] Date of Patent: Dec. 20, 1994

[54] PORTABLE BOWLING ALLEY WITH BALL RETURN

[76] Inventor: Kevin D. Burtchett, RR. #3 Box 415-1, Mansfield, Mo. 65704

[21] Appl. No.: 124,580

[22] Filed: Sep. 22, 1993

[51] Int. Cl.[5] ..... A63D 3/00

[52] U.S. Cl. ..... 473/116; 473/110; 473/114; 273/179 C

[58] Field of Search ..... 473/98, 106, 109, 110, 473/111, 112, 113, 114, 116; 273/179 C

[56] References Cited

U.S. PATENT DOCUMENTS

| | | | |
|---|---|---|---|
| 2,232,569 | 2/1941 | Johnson | 273/179 C |
| 2,615,716 | 10/1952 | Montooth et al. | 473/112 |
| 3,065,965 | 11/1962 | Cervetti | 473/112 |
| 3,372,931 | 3/1968 | Oberg | 473/109 |

*Primary Examiner*—vincent Millin
*Assistant Examiner*—William M. Pierce
*Attorney, Agent, or Firm*—Michael I. Kroll

[57] ABSTRACT

An ultimate bowling simulator is provided which consists of a miniature bowling alley, with a pit unit located behind the alley. A structure is for elevating the alley in an upwardly tilted rearward gravity feed position with respect to the pit unit. Ten small pins are set up in a triangular rack formation directly in front of the pit unit. A plurality of small bowling balls are provided, so that each can be rolled down the alley to knock down the pins. A ball return extends from one side of the it unit. A component within the pit unit is for separating the pins from the bowling balls, so that the bowling balls can go into the ball return, while the pins will stay in the pit unit.

5 Claims, 2 Drawing Sheets

PORTABLE BOWLING ALLEY WITH BALL RETURN

BACKGROUND OF THE INVENTION

1. Field of the Invention

The instant invention relates generally to bowling games and more specifically it relates to an ultimate bowling simulator.

2. Description of the Prior Art

Numerous bowling games have been provided in prior art that are adapted to be played by rolling a ball down a smooth level wooden alley in order to knock down a triangular group of ten pins. While these units may be suitable for the particular purpose to which they address, they would not be as suitable for the purposes of the present invention as heretofore described.

SUMMARY OF THE INVENTION

A primary object of the present invention is to provide an ultimate bowling simulator that will overcome the shortcomings of the prior art devices.

Another object is to provide an ultimate bowling simulator that is a miniature portable gravity feed bowling game utilizing small pins and bowling balls, so that a child can play the bowling game in the home and any other location.

An additional object is to provide an ultimate bowling simulator that includes a trough for separating the pins and the bowling balls located in a pit unit behind a bowling alley, so that the bowling balls can go into a ball return while the pins will drop down into a storage compartment below to be set up again.

A further object is to provide an ultimate bowling simulator that is simple and easy to use.

A still further object is to provide an ultimate bowling simulator that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
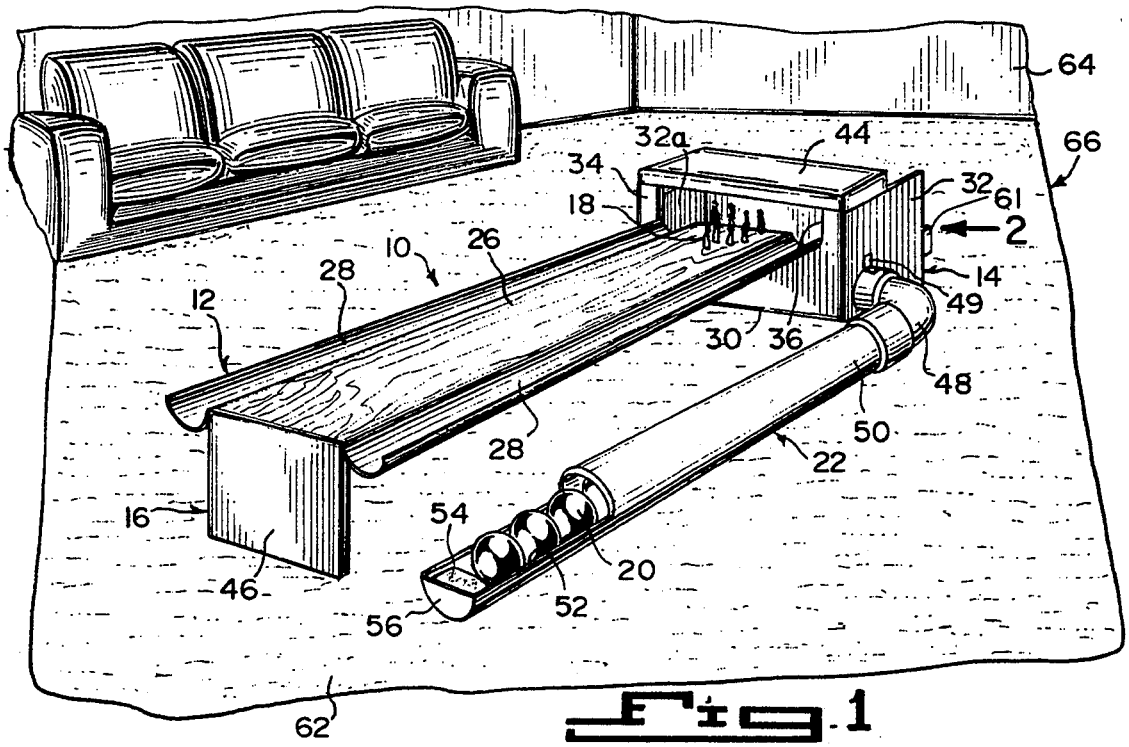
FIG. 1 is a front perspective view of the instant invention placed upon a floor in a building.

Turning now descriptively to the drawings, in which similar reference characters denote similar elements throughout the several views, FIGS. 1 through 4 illustrate an ultimate bowling simulator 10, which consists of a miniature bowling alley 12 with a pit unit 14 located behind the alley 12. A structure 16 is for elevating the alley 12 in an upward tilted rearward gravity feed position with respect to the pit unit 14. Ten small pins 18 are set up in a triangular rack formation directly in front of the pint unit 14. A plurality of small bowling balls 20 are provided, so that each can be rolled down the alley 12 to knock down the pins 18. A ball return 22 extends from one side of the pit unit 14. A component 24 within the pit unit 14 is for separating the pins 18 from the bowling balls 20, so that the bowling balls 20 can go into the ball return 22, while the pins 18 will stay in the pit unit 14.

The alley 12 includes a smooth rectangular lane 26 and a pair of gutter channels 28, each affixed to an opposite side edge of the lane 26.

The pit unit 14 contains a bottom wall 30, with a pair of side walls 32, **32*a* extending upwardly from the bottom wall 30. A front wall 34 has a cutout area 36, for receiving back edges of the lane 26 and the gutter channels 28. A partition 38 extends between the side walls 32 and 32*a*, in which a lower edge 40 of the partition 38 is spaced above the bottom wall 30, so as to form a storage compartment 42 therein, for the pins 18. A narrow rear wall 43 extends upwardly from the bottom wall 30, to prevent the pins 18 from falling out of the storage compartment 42**.

A lid 44 is sized to cover an area between upper edges of the front wall 34, the partition 38 and the side walls 32 and **32*a*. The elevating structure 16 is a front support leg 46, extending downwardly from a front edge of the lane 26**.

The ball return 22 includes an elbow pipe 48 extending through the first side wall 32 of the pit unit 14. A fastener 49 is for connecting the elbow pipe 48 to the first side wall 32 of the pit unit 14. An elongate pipe 50 extends from the elbow pipe 48 in a downwardly titled forward gravity feed position and has a bottom cutout area 52 located adjacent the front support leg 46. A stop member 54 is located at a distal end 56 of the elongate pipe 50 in the bottom cutout area 52.

Figure 4:
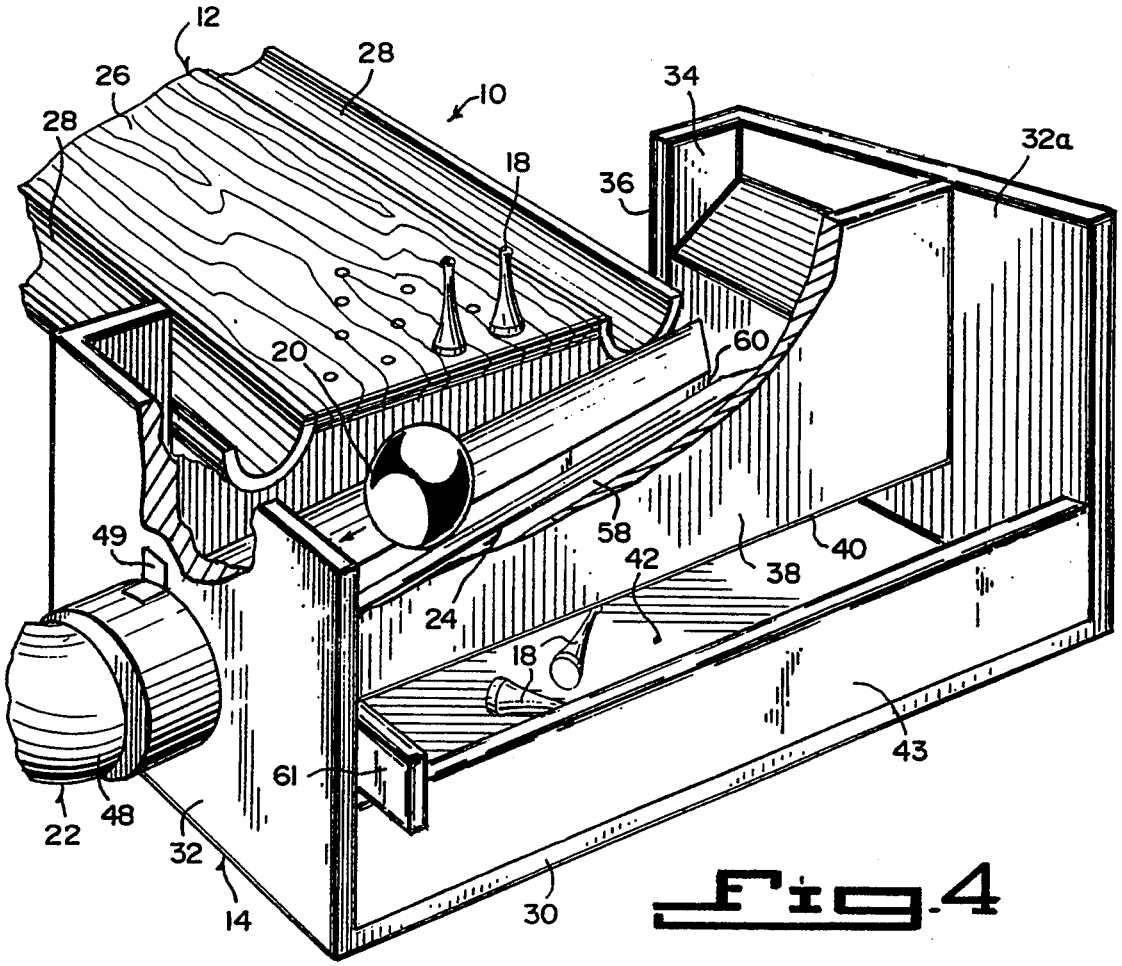
FIG. 4 is an enlarged rear perspective view with parts broken away, showing the trough in greater detail.

The separating component 24, as best seen in FIG. 4, is a trough 58 having a central slot 60 therethrough. The trough 58 is positioned within the pit unit 14 between the front wall 34, the partition 38 and the side walls 32 and **32*a* in a downwardly tilted gravity feed position, below the back edges of the lane 26 and the gutter channels 28 to the elbow pipe 48 of the ball return 22 in the first side wall 32. The bowling balls 20 can travel along the trough 58, through the elbow pipe 48 and into the elongate pipe 50, to the stop member 54. The pins 18 when knocked over by the bowling balls 20, will drop through the central slot 60 into the storage compartment 42 within the pit unit 14**, to be eventually removed therefrom and set up again.

A sliding door 61 is positioned between the first side wall 32 and the trough 58. When the sliding door 61 is placed in a closed position, it will prevent the bowling balls 20 from entering the ball return 22.

Each bowling ball 20 is approximately the same size as a golf ball. Each pin 18 is approximately the same size and shape as a golf tee. The lane 26 is fabricated out of wooden material. The bottom wall 30, the side walls 32 and **32*a*, the front wall 34, the partition 38 and the narrow rear wall 43 of the pit unit 14** are all fabricated out of metal material.

The ultimate bowling simulator 10 can separate into three basic parts that include the bowling alley 12, the pit unit 14 and the ball return 22. This will allow for an easier storage when not in use.

OPERATION OF THE INVENTION

Figure 2:
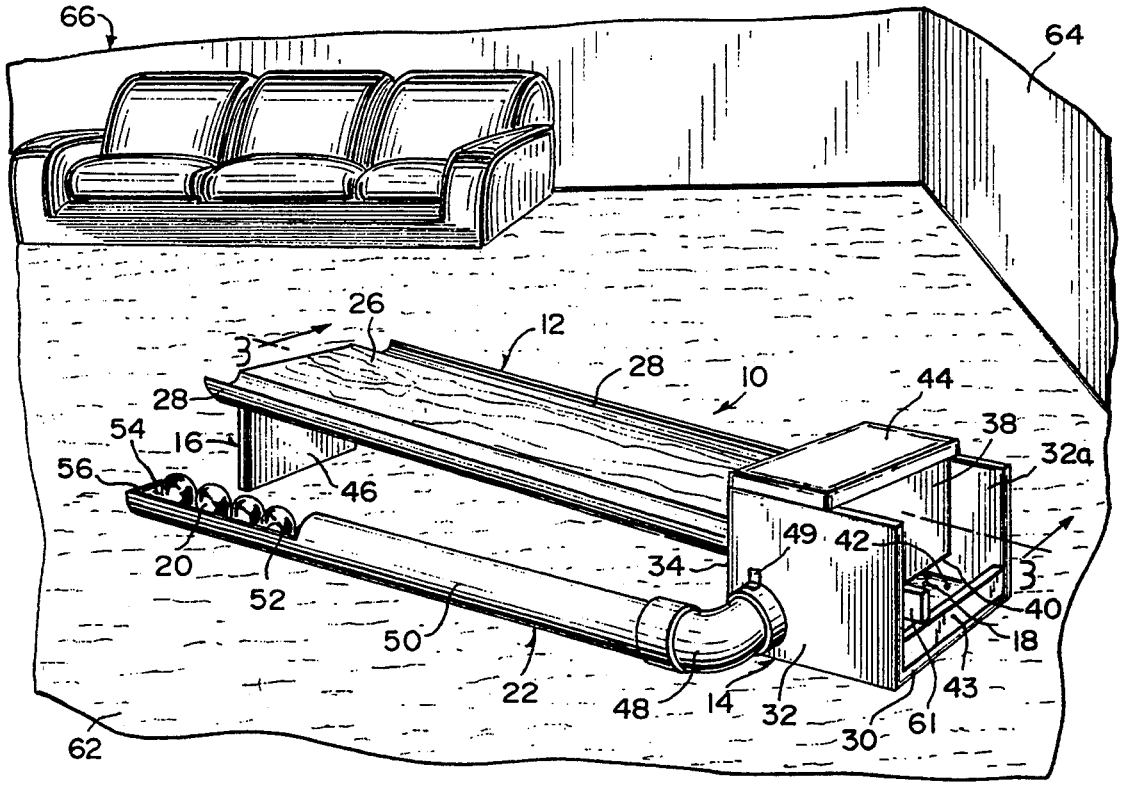
FIG. 2 is a rear perspective view taken in direction of arrow 2 in FIG. 1.
Figure 3:
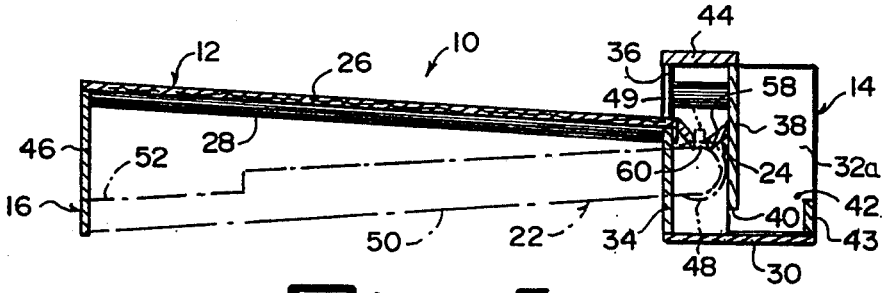
FIG. 3 is a cross sectional view taken along line 3—3 in FIG. 2.

To use the ultimate bowling simulator 10 a child can simply follow the steps listed below:

1. Set up the ultimate bowling simulator 10 on the floor 62 in a room 64 of a building 66, such as a house as shown in FIGS. 1 and 2.
2. Place the pins 18 so that they are set up in the triangular rack formation directly in front of the pit unit 14.
3. Roll the bowling ball 20 down the lane 26 to try and knock the pins 18 over, so that the pins will fall through the central slot 60 in the trough 58.
4. Retrieve the bowling ball 20 from the bottom cutout area 52 after it travels from the trough 58 past the elbow pipe 50 into the elongate pipe 50 to the stop member 52.
5. Roll the bowling ball 20 again down the lane 26 if some of the pins 18 are still standing on the lane 26.
6. Play with the ultimate bowling simulator 10 as you would play a regular bowling game, so as to try to receive the best score possible by yourself or with other players.

LIST OF REFERENCE NUMBERS

10 ultimate bowling simulator
12 miniature bowling alley
14 pit unit
16 elevating structure
18 small pin
20 small bowling ball
22 ball return
24 separating component
26 smooth rectangular lane
28 gutter channel
30 bottom wall of 14
32 first side wall of 14
**32*a* second side wall of 14**
34 front wall of 14
36 cutout area in 34
38 partition
40 lower edge of 38
42 storage compartment in 14
43 narrow rear wall of 14
44 lid
46 front support leg for 16
48 elbow pipe
49 fastener
50 elongate pipe
52 bottom cutout area on 50
54 stop member
56 distal end of 50
58 trough
60 central slot in 58
61 sliding door between 32 and 58
62 floor
64 room
66 building It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An ultimate bowling simulator which comprises:

a) a miniature bowling alley, said alley including a smooth rectangular lane and a pair of gutter channels, each affixed to an opposite side edge of said lane;

b) a pit unit located behind said alley, said pit unit including a bottom wall, a pair of side walls extending upwardly from said bottom wall, a front wall having a cutout area for receiving back edges of said lane and said gutter channels, a partition extending between said side walls, in which a lower edge of said partition is spaced above said bottom wall, so as to form a storage compartment therein for said pins, a narrow rear wall extending upwardly from said bottom wall, to prevent said pins from falling out of said storage compartment, and a lid sized to cover an area between upper edges of said front wall, said partition and said side walls;

c) means for elevating said alley in an upwardly titled rearward gravity feed position with respect to said pit unit, said elevating means is a front support leg extending downwardly from a front edge of said lane;

d) ten small pins to be setup in a triangular rack formation directly in front of said pit unit;

e) a plurality of small bowling balls, each of which is rolled down said alley to knock down said pins;

f) a ball return extending from one side of said pit unit, said ball return including an elbow pipe extending through said first side wall of said pit unit, a fastener for connecting said elbow pipe to said first side wall of said pit unit, an elongate pipe extending from said elbow pipe in a downwardly tilted forward gravity feed position and having a bottom cutout area located adjacent said front support leg, and a stop member located at a distal end of said elongate pipe in said bottom cutout area;

g) means within said pit unit for separating said pins from said bowling balls, so that said bowling balls can go into said ball return, while said pins will stay in said pit unit, said separating means including a trough having a central slot therethrough, said trough positioned within said pit unit between said front wall and said partition and said side walls in a downwardly tilted gravity feed position below said back edges of said lane and said gutter channels to said elbow pipe of said ball return in said first side wall, so that said bowling balls can travel along said trough, through said elbow pipe and into said elongate pipe to said stop member, while said pins when knocked over by said bowling balls will drop through said central slot into said storage compartment within said pit unit, to be eventually removed therefrom and set up again; and h) a sliding door positioned between said first side wall and said trough, so that when said sliding door is placed in a closed position it will prevent said bowling balls from entering said ball return.

2. An ultimate bowling simulator as recited in claim 1, wherein each said bowling ball is approximately the same size as a golf ball.

3. An ultimate bowling simulator as recited in claim 2, wherein each said pin is approximately the same size and shape as a golf tee.

4. An ultimate bowling simulator as recited in claim 3, wherein said lane is fabricated out of wooden material.

5. An ultimate bowling simulator as recited in claim 4, wherein said bottom wall, said side walls, said front wall, said partition and said narrow rear wall of said pit unit are all fabricated out of metal material.

* * * * *